US011225832B2

(12) United States Patent
Seo

(10) Patent No.: US 11,225,832 B2
(45) Date of Patent: Jan. 18, 2022

(54) AUTOMATIC LADDER HAVING LENGTH ADJUSTABLE BY ELECTRIC DRIVER

(71) Applicant: Dong Yeong Seo, Daegu (KR)

(72) Inventor: Dong Yeong Seo, Daegu (KR)

( * ) Notice: Subject to any disclaimer, the term of this patent is extended or adjusted under 35 U.S.C. 154(b) by 406 days.

(21) Appl. No.: 16/345,565

(22) PCT Filed: Oct. 31, 2017

(86) PCT No.: PCT/KR2017/012121
§ 371 (c)(1),
(2) Date: Apr. 26, 2019

(87) PCT Pub. No.: WO2018/084519
PCT Pub. Date: May 11, 2018

(65) Prior Publication Data

US 2019/0316415 A1 Oct. 17, 2019

(30) Foreign Application Priority Data

Nov. 2, 2016 (KR) ..... 10-2016-0144836

(51) Int. Cl.
*E06C 1/22* (2006.01)
*E06C 1/39* (2006.01)
(Continued)

(52) U.S. Cl.
CPC ..... *E06C 1/22* (2013.01); *E06C 1/39* (2013.01); *E06C 7/02* (2013.01); *E06C 7/04* (2013.01); *E06C 7/08* (2013.01); *E06C 7/16* (2013.01)

(58) Field of Classification Search
CPC ..... E06C 1/22; E06C 1/39; E06C 7/02; E06C 7/04; E06C 7/08; E06C 7/16
See application file for complete search history.

(56) References Cited

U.S. PATENT DOCUMENTS 284,683 A * 9/1883 Swenson ..... E06C 1/22 182/168
1,077,650 A * 11/1913 Stroud ..... E06C 1/22 182/168
(Continued)

FOREIGN PATENT DOCUMENTS

CN 106050119 A 10/2016
JP 2006-250303 A 9/2006
JP 2016-121014 A 7/2016

*Primary Examiner* — Colleen M Chavchavadze
(74) *Attorney, Agent, or Firm* — Maschoff Brennan

(57) ABSTRACT

According to the present invention, a ladder having an adjustable length comprises: a first support including a first outer support and a first inner support inserted into the first outer support; a horizontal foothold for connecting the first supports to each other; a first gear formed at the inner side of the horizontal foothold and having a groove part formed therein; a second gear engaging with the first gear and changing the rotational direction of the first gear; a rotary bar coupled to the second gear; a third gear formed at the end of one side of the rotary bar; a screw bolt having a fourth gear, which engages with the third gear and is formed at the end thereof, formed inside the first inner support, formed in a stick type, and having threads formed on the outer side thereof; and a screw nut in which the screw bolt is formed, and to which the first inner support is coupled at the outer side thereof.

4 Claims, 8 Drawing Sheets

(51) Int. Cl.

| | |
|---|---|
| ***E06C 7/02*** | (2006.01) |
| ***E06C 7/04*** | (2006.01) |
| ***E06C 7/08*** | (2006.01) |
| ***E06C 7/16*** | (2006.01) |

(56) References Cited

U.S. PATENT DOCUMENTS

| | | | | | |
|---|---|---|---|---|---|
| 1,423,104 | A * | 7/1922 | Glasser | E06C 9/10 | 182/208 |
| 2,376,529 | A * | 5/1945 | Yarmolowich | E06C 7/16 | 182/209 |
| 2,880,920 | A * | 4/1959 | Glessner | E06C 1/22 | 182/166 |
| 3,692,143 | A * | 9/1972 | Kummerlin | E06C 7/081 | 182/24 |
| 3,799,289 | A * | 3/1974 | Cecere, Jr. | B66B 9/16 | 182/145 |
| 5,033,584 | A * | 7/1991 | Battle | E06C 1/12 | 182/168 |
| 5,145,031 | A * | 9/1992 | Sprunger | E06C 1/38 | 182/103 |
| 7,370,725 | B1 * | 5/2008 | Dornfeld | E06C 7/081 | 182/102 |
| 8,011,473 | B1 * | 9/2011 | Gregersen | E06C 1/16 | 182/102 |
| 8,292,039 | B2 * | 10/2012 | Campbell | B66F 11/04 | 187/261 |
| 2019/0186203 | A1 * | 6/2019 | Groah | B66D 1/36 | |

* cited by examiner

AUTOMATIC LADDER HAVING LENGTH ADJUSTABLE BY ELECTRIC DRIVER

TECHNICAL FIELD

The present invention relates to an automatic ladder whose length is adjustable and, more particularly, to an automatic ladder that is capable of being adjustable in length by means of an electric tool like an electric driver or a tool like an auxiliary handle.

BACKGROUND ART

Generally, a ladder, which is used for climbing up and down, is divided into a ladder for work and a ladder for passage. The ladder has both vertical supports and a plurality of horizontal footholds fixed to a space between the vertical supports in such a manner as to be spaced apart from each other at given intervals in up and down directions. Accordingly, the ladder serves to supportedly connect the ground and upper floors to move to the upper or lower floors or to allow various aerial work to be freely carried out thereon.

FIG. 1 is a perspective view showing a conventional ladder. As shown in FIG. 1, the conventional ladder has a pair of vertical supports 110 and a plurality of horizontal footholds 120 disposed spaced apart from each other at given intervals between the pair of vertical supports 110. Further, a work foothold 130 is disposed on tops of the vertical supports 110 to allow a worker to work thereon. Generally, the ladder is adjustable in an angle between the vertical supports 110, but it is fixed in height. In conventional practices, further, a ladder having a double structure is adjustable in length by means of manual assembling, but in this case, the time required to dissemble and assemble the ladder is increased, thereby undesirably lowering a working efficiency.

Furthermore, the general assembling type manual ladder has to be disassembled and assembled again at the time of being moved between work places, and its volume becomes also bulky, thereby undesirably increasing a worker's fatigue.

DISCLOSURE

Technical Problem

Accordingly, the present invention has been made in view of the above-mentioned problems occurring in the prior art, and it is an object of the present invention to provide an automatic ladder that is capable of being adjustable in length.

It is another object of the present invention to provide an automatic ladder that is capable of being adjustable in angle.

It is still another object of the present invention to provide an automatic ladder that is capable of being adjustable in length and angle within a shorter time than the time required in exiting ladders.

It is yet another object of the present invention to provide an automatic ladder that is capable of enhancing a worker's working efficiency.

It is still yet another object of the present invention to provide an automatic ladder that is capable of being adjustable in length and angle, without any use of electricity.

It is another object of the present invention to provide an automatic ladder that is capable of being easily installed, kept, and moved.

Technical Solution

To accomplish the above-mentioned objects, according to a first aspect of the present invention, there is provided an automatic ladder whose length is adjustable, including: a first support part having first outer supports and first inner supports inserted into the first outer supports; horizontal footholds for connecting the first outer supports and for connecting the first inner supports; a first gear disposed inside one horizontal foothold and having a groove portion formed at the inside thereof; a second gear engaging with the first gear to change a rotational direction of the first gear; a rotary bar coupled to the second gear; third gears located on both ends of the rotary bar; screw bolts having fourth gears engaging with the third gears, located inside the first inner supports, taking shapes of bars, and having screw lines formed on the outer peripheral surfaces thereof; and screw nuts fitted to the screw bolts in such a manner as to allow the outer surfaces thereof to be fixedly coupled to the first inner supports.

To accomplish the above-mentioned objects, according to a second aspect of the present invention, there is provided an automatic ladder whose length is adjustable, including: a first support part having first outer supports and first inner supports inserted into the first outer supports; horizontal footholds for connecting the first outer supports and for connecting the first inner supports; an electric motor; a rotary bar rotating by means of rotation of the electric motor; third gears located on both ends of the rotary bar; screw bolts having fourth gears engaging with the third gears, located inside the first inner supports, taking shapes of bars, and having screw lines formed on the outer peripheral surfaces thereof; a battery for driving the electric motor; and screw nuts fitted to the screw bolts in such a manner as to allow the outer surfaces thereof to be fixedly coupled to the first inner supports.

To accomplish the above-mentioned objects, according to a third aspect of the present invention, there is provided an automatic ladder whose length is adjustable, including: a first support part having first outer supports and first inner supports inserted into the first outer supports; horizontal footholds for connecting the first outer supports and for connecting the first inner supports; a first gear disposed inside one horizontal foothold and having a groove portion formed at the inside thereof; a second gear engaging with the first gear to change a rotational direction of the first gear; a rotary bar coupled to the second gear; third gears located on both ends of the rotary bar; and any ones of chain belts and rack gears connected to the third gears in such a manner as to allow the outer surfaces thereof to be coupled to the first inner supports.

Advantageous Effects

According to the present invention, the automatic ladder can be adjusted in angle as well as length. Further, the automatic ladder according to the present invention is configured to allow the inner supports extendable from the outer supports to be accommodated in the outer supports, and if necessary, the inner supports are extended from the outer supports, so that the ladder of the present invention can be easily moved and kept.

In addition, the automatic ladder according to the present invention is adjustable in length by means of various tools like the electric driver, the auxiliary handle, and so on, and even in a place where no electricity can be used, particularly, the length of the ladder can be extended.

Further, the automatic ladder according to the present invention is adjustable in length and angle within a short time, through the electric motor, in a place where electricity can be easily supplied, thereby enhancing a working efficiency.

MODE FOR INVENTION

Objects, characteristics and advantages of the present invention will be more clearly understood from the detailed description as will be described below and the attached drawings. Hereinafter, an explanation on an automatic ladder whose length is adjustable according to the present invention will be in detail given so as to allow the embodiments of the present invention to be understood to one of ordinary skill in the art.

Figure 1:
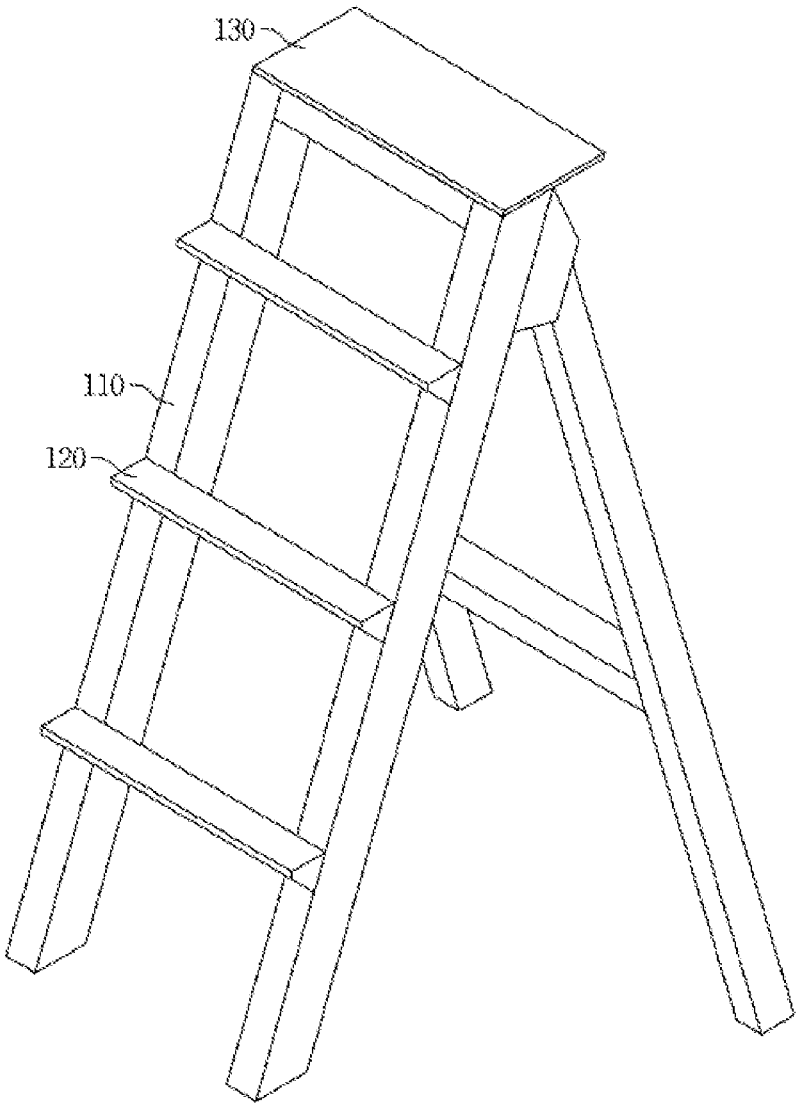
FIG. 1 is a perspective view showing a conventional ladder.
Figure 2:
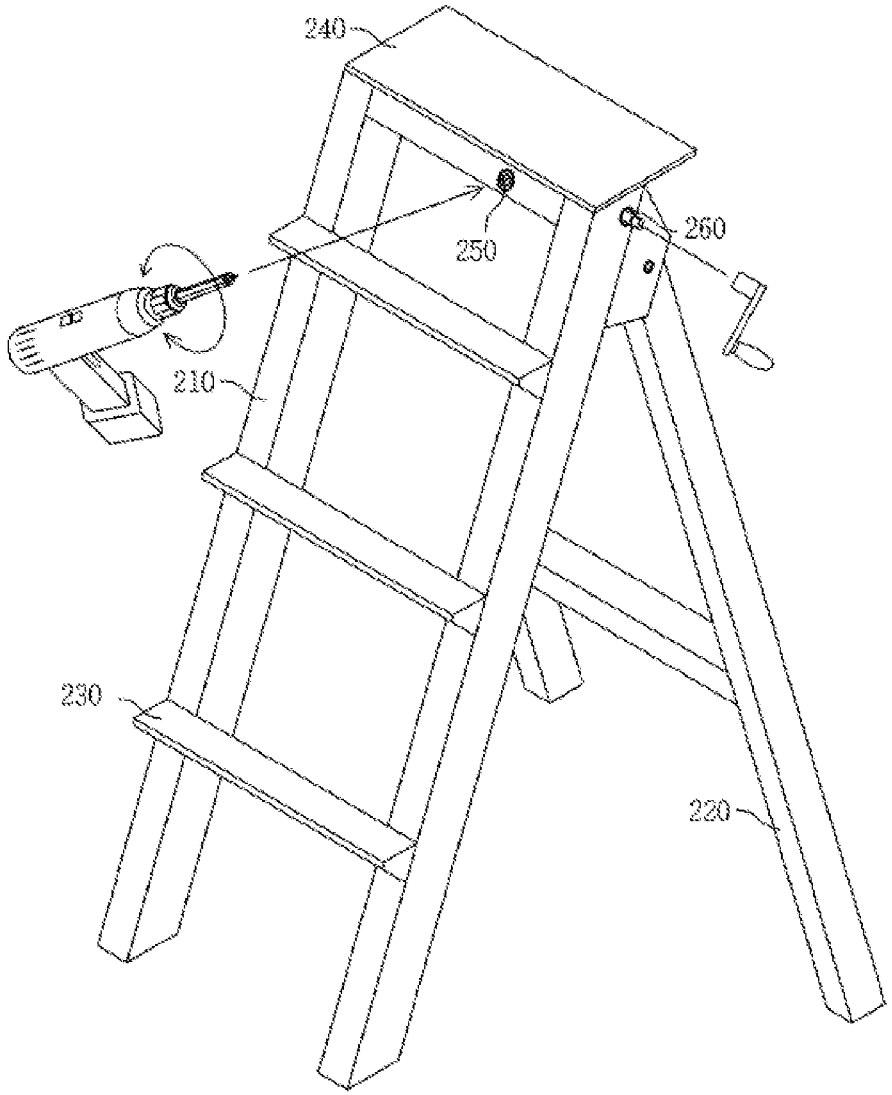
FIG. 2 is a perspective view showing a ladder whose length is adjustable according to the present invention.

FIG. 2 is a perspective view showing a ladder whose length is adjustable according to the present invention. Hereinafter, an explanation on the automatic ladder whose length is adjustable according to the present invention will be in detail given with reference to FIG. 2.

As shown in FIG. 2, a ladder whose length is adjustable according to the present invention largely includes a first support part 210, a second support part 220, horizontal footholds 230, and a work foothold 240. In addition to the components as mentioned above, of course, other components may be included in the ladder whose length is adjustable according to the present invention.

The horizontal footholds 230 are disposed spaced apart from each other at given intervals on the first support part 210. The work foothold 240 on which a worker stands to work is disposed on top of the first support part 210. The second support part 220 is hinge-coupled to the first support part 210 so that it is easily adjustable in angle with respect to the first support part 210.

According to the present invention, a center gearbox 250 is disposed inside any one of the horizontal footholds 230 located on the first support part 210, and a side gearbox 260 is disposed on one side surface of the first support part 210. The center gearbox 250 disposed inside the horizontal foothold 250 or the side gearbox 260 is manipulated by the worker so as to extend the length of the first support part 210. Of course, the center gearbox 250 may be disposed not inside the horizontal foothold 230, but inside another member. Now, an internal structure of the first support part 210 of the ladder according to the present invention, in which the center gearbox 250 and the side gearbox 260 are disposed, will be in detail explained with reference to FIG. 3.

Figure 3:
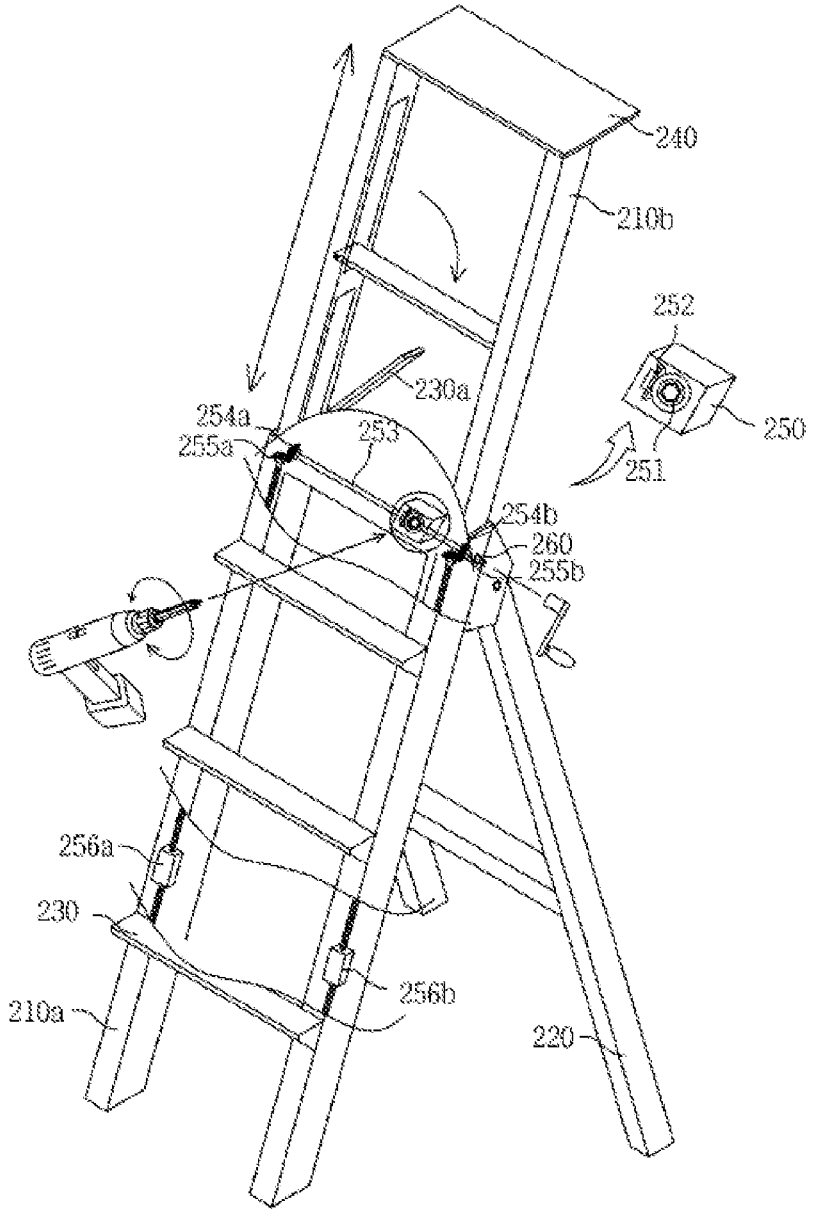
FIG. 3 is a perspective view showing an internal structure of a first support part of the ladder according to the present invention, in which a center gearbox and a side gearbox are disposed.

FIG. 3 is a perspective view showing an internal structure of the first support part of the ladder according to the present invention, in which the center gearbox and the side gearbox are disposed. Hereinafter, the internal structure of the first support part of the ladder according to the present invention, in which the center gearbox and the side gearbox are disposed, will be in detail explained with reference to FIG. 3.

As shown in FIG. 3, the first support part 210 includes first outer supports 210*a* disposed at the outside and first inner supports 210*b* disposed at the inside of the first outer supports 210*a*. The second support part 220 is hinge-coupled to the first outer supports 210*a*, and through the hinge coupling, an angle between the first outer supports 210*a* and the second support part 220 is adjustable.

The work foothold 240 is located on tops of the first inner supports 210*b*. The center gearbox 250 is located inside any one of the horizontal footholds 230 connecting the two bar-shaped first outer supports 210*a*. The center gearbox 250 includes a first gear 251 and a second gear 252. The first gear 251 and the second gear 252 have shapes of bevel gears. The horizontal footholds 230 further include second horizontal footholds 230*a* for connecting the first inner supports 210*b*.

The first gear 251 has a groove portion formed at the center thereof so that it rotates through the rotation of the groove portion. The groove portion formed at the inside of the first gear 251 has a shape corresponding to the end portion of an electric driver so that it can insert the end portion of the electric driver thereinto.

As shown in FIG. 3, the second gear 252 engages with the first gear 251 and rotates in a perpendicular direction to a rotating direction of the first gear 251.

The second gear 252 is disposed on a rotary bar 253, and third gears 254 are located on both ends of the rotary bar 253. In detail, one side third gear 254*a* is disposed on one side end of the rotary bar 253, and the other side third gear 254*b* on the other side end of the rotary bar 253. The rotary bar 253 is disposed inside the horizontal foothold 230, like the center gearbox 250, and the third gears 254 are disposed inside the first inner supports 210*b*.

Screw bolts 255 are located inside the first inner supports 210*b* in such a manner as to be extended by a given length in longitudinal directions of the first inner supports 210*b*, and they are not fastened directly to the first inner supports 210*b*. The screw bolts 255 have shapes of bars having screw lines formed on the outer peripheral surfaces thereof. The first screw bolt 255*a* is disposed inside any one of the two bar-shaped first inner supports 210*b*, and the second screw bolt 255*b* is inside the other first inner support 210*b*.

Gears are located on tops of the screw bolts 255 in such a manner as to engage with the third gears 254. In more detail, one side fourth gear is disposed on top of the first screw bolt 255*a*, and the other side fourth gear is on top of the second screw bolt 255*b*. One side fourth gear engages with one side third gear 254*a* and changes a rotating direction of one side third gear 254*a* to an angle of 90°. The other side fourth gear engages with the other side third gear 254*b* and changes a rotating direction of the other side third gear 254*a* to a right angle direction. To do this, the third gears and the fourth gears have shapes of bevel gears.

Screw nuts 256 are fitted to the outer peripheries of the screw bolts 255, and through the rotation of the screw bolts 255, they move up and down along the screw bolts 255. The screw bolts 255 are inserted into the screw nuts 256, and the outer surfaces thereof are fixedly coupled to the first inner supports 210*b*. Accordingly, the first inner supports 210*b* move together with the screw nuts 256. In more detail, if the screw nuts 256 move upward along the screw bolts 255, the first inner supports 210*b* also move upward. On the other hand, if the screw nuts 256 move downward along the screw bolts 255, the first inner supports 210*b* also move downward. As shown in FIG. 3, the screw nuts 256 are formed of the first screw nut 256*a* and the second screw nut 256*b*. The first screw nut 256*a* is disposed inside any one of the first inner supports, and the second screw nut 256*b* inside the other first inner support.

In more detail, if the first gear 251 of the center gearbox 250 is rotated by means of the electric screwdriver manipulated by the worker, the second gear 252 rotates by means of the rotation of the first gear 251, and the third gears 254 coupled to the rotary bar 253 rotate through the rotation of the second gear 252.

If the third gears 254 rotate, the fourth gears engaging with the third gears 254 rotate, and the screw bolts 255 having the fourth gears disposed thereon rotate through the rotation of the fourth gears. The screw nuts 256 coupled to the screw bolts 255 move upward and downward through the rotation of the screw bolts 255, and the first inner supports 210 fixedly coupled to the screw nuts 256 move upward and downward through the upward and downward movements of the screw nuts 256. That is, the first inner supports move upward and downward from and to the first outer supports.

In addition, the side gearbox 260 is located on one side of the first support part, and side gears constituting the side gearbox 260 are connected to the third gears 254 or the rotary bar 253. In detail, if the side gears rotate, the third gears 254 also rotate. Particularly, FIG. 3 shows an example wherein the side gears constituting the side gearbox disposed on one side of the first support part are rotated by means of an auxiliary handle, and the side gears will be in detail explained later.

FIGS. 4*a* to 4*d* are perspective views showing operations of the ladder whose length is adjustable according to the present invention. Hereinafter, the operations of the ladder whose length is adjustable according to the present invention will be in detail explained with reference to FIGS. 4*a* to 4*d*. As mentioned above, the length of the ladder can be extended by means of the electric driver or the auxiliary handle.

Figure 4:
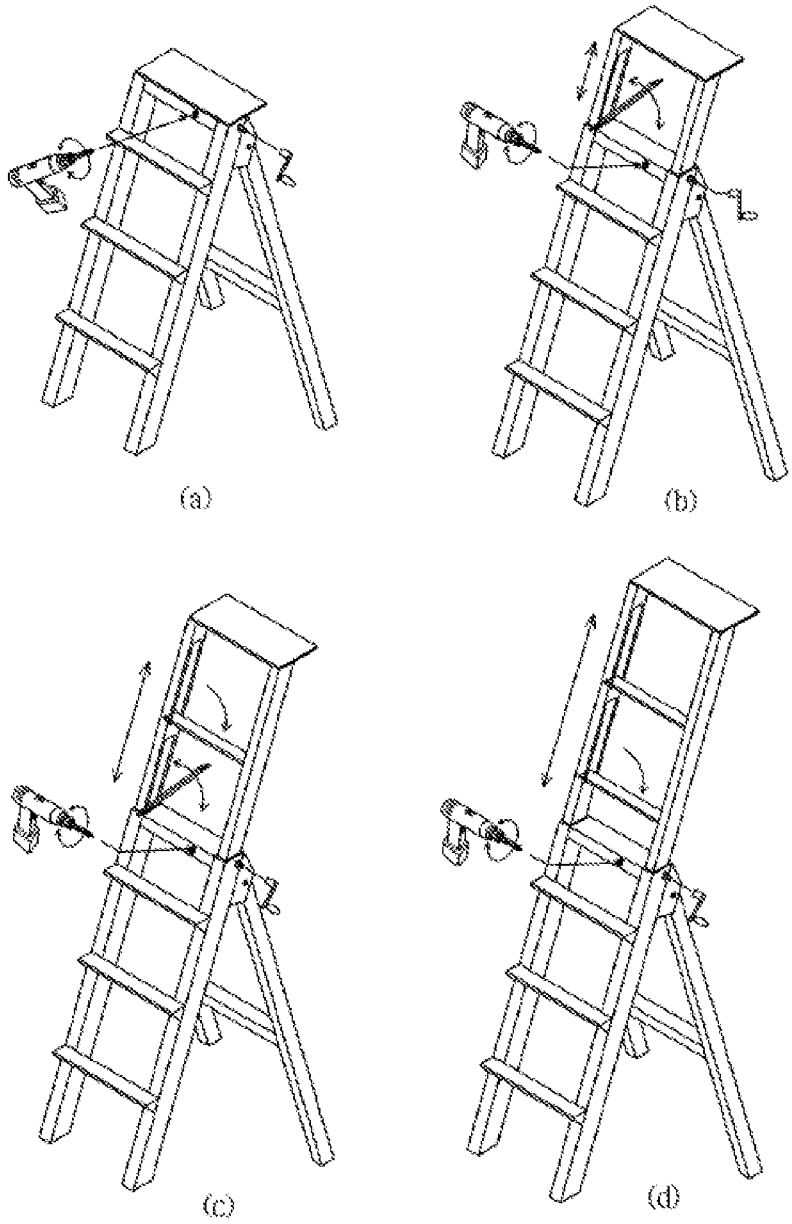
FIGS. 4*a* to 4*d* are perspective views showing operations of the ladder whose length is adjustable according to the present invention.

As shown in FIG. 4*a*, the first gear 251 of the center gearbox 250 rotates by means of the electric driver, or the side gears rotate by means of the auxiliary handle.

As shown in FIG. 4*b*, if the first gear 251 of the center gearbox 250 rotates by means of the electric driver, or if the side gears rotate by means of the auxiliary handle, the first inner supports inserted into the first outer supports are drawn to the outside.

As shown in FIG. 4*c*, the horizontal footholds are accommodated or brought into close contact with one side surface of the first inner supports, and if the first inner supports are drawn from the first outer supports to the outside, the horizontal footholds, which are accommodated or brought into close contact with one side surface of one side first inner supports, are rotated and fixed to the other side surface of the first inner supports. To do this, the horizontal footholds, which are accommodated or brought into close contact with one side surface of the first inner supports, are hinge-coupled to one side first inner support, and the other side first inner support has protrusions protruding from the side surface thereof. Accordingly, the horizontal footholds are fixed to the other side first inner support by means of the protrusions formed from the side surface of the other side first inner support. The horizontal footholds connect the first inner supports, and they are divided into the first horizontal footholds hinge-coupled to the first inner supports and the second horizontal footholds connecting the second outer supports.

As shown in FIG. 4*d*, if the first inner supports are drawn by a worker's desired length from the first outer supports to the outside, the rotation of the first gear or the side gears is stopped by the worker.

So as to allow the first inner supports drawn from the first outer supports to the outside to be inserted into the first outer supports, of course, the first gear or the side gears is (are) rotated in an opposite direction to the rotating direction as mentioned.

Figure 5:
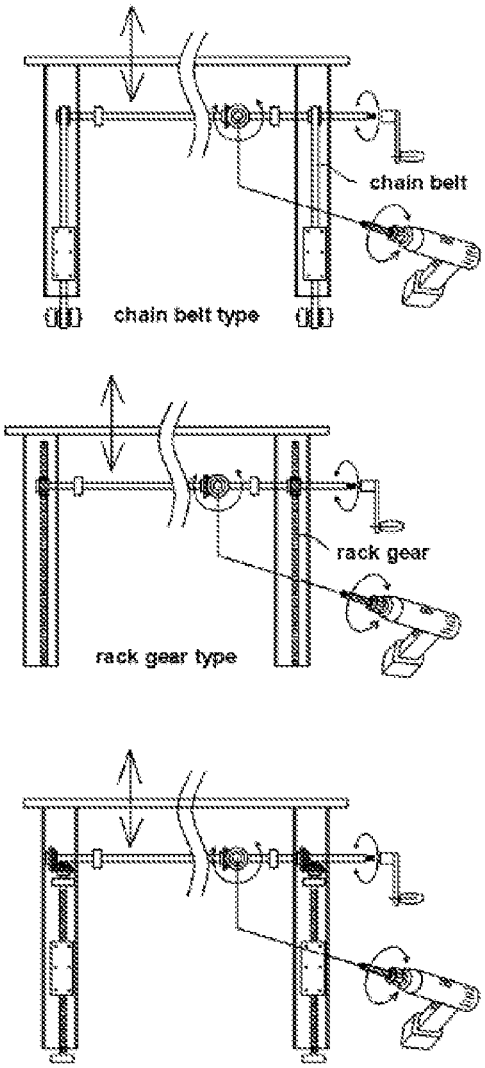
FIG. 5 is a sectional view showing operations for moving first inner supports upward and downward to and from first outer supports by means of an electric driver in the ladder according to the present invention.

FIG. 5 is a sectional view showing operations for moving the first inner supports upward and downward to and from the first outer supports by means of the electric driver in the ladder according to the present invention. Hereinafter, the operations for moving the first inner supports upward and downward to and from the first outer supports by means of the electric driver will be in detail explained with reference to FIG. 5.

As shown in FIG. 5, the operations for moving the first inner supports upward and downward to and from the first outer supports by means of the electric driver are carried out by means of chain belts, rack gears, or screws. In addition thereto, of course, other members are adopted to draw the first inner supports from the first outer supports to the outside.

In case of the screws, as shown in FIG. 2, the screw bolts and the screw nuts are provided, and accordingly, the screw bolts rotate to allow the screw nuts to move upward and downward therealong, so that the first inner supports fixedly fastened to the screw nuts also move upward and downward.

In case of the chain belts, the ends of the rotary bar are connected to rotary bars disposed on the bottom of the first support part by means of the chain belts. As the rotary bar rotates, the chain belts connected to the rotary bar also rotate. The chain belts are fixedly fastened to the first inner supports, and accordingly, the first inner supports move upward and downward from and into the first outer supports through the rotation of the chain belts.

The adoption of the rack gears is similar to that of the chain belts, excepting that the rack gears are used instead of the chain belts. The first inner supports move upward and downward from and into the first outer supports through the rotation of the rack gears fixedly connected thereto. In detail, the third gears are disposed on the ends of the rotary bar, and through the rotation of the third gears, the rack gears rotate. Through the rotation of the rack gears, accordingly, the first inner supports fixedly connected to the rack gears move upward and downward from and into the first outer supports.

Figure 6:
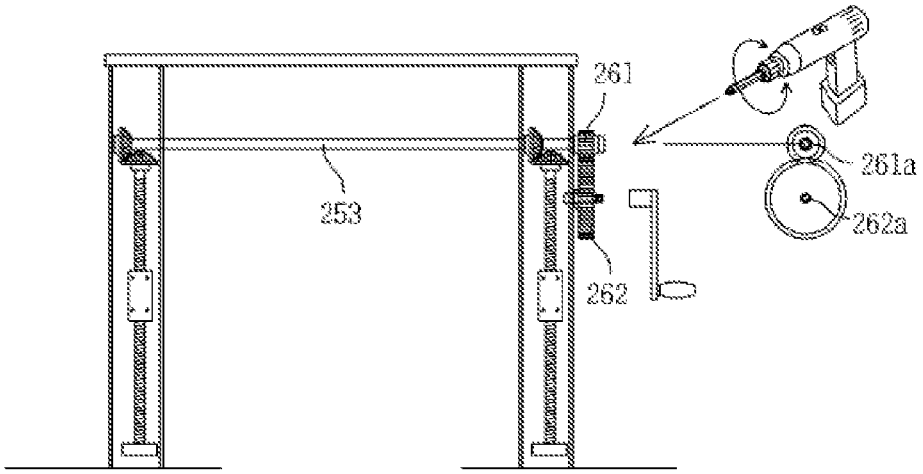
FIG. 6 is a sectional view showing a structure of the side gearbox in the ladder according to the present invention.

FIG. 6 is a sectional view showing a structure of the side gearbox in the ladder according to the present invention. Now, the structure of the side gearbox in the ladder according to the present invention will be in detail explained with reference to FIG. 6.

As shown in FIG. 6, the side gearbox includes a first side gear 261 and a second side gear 262, and the first side gear 261 is disposed on one end of the rotary bar 253. In detail, the first side gear 261 is disposed on one end of the rotary bar 253, and the third gears are located at points spaced apart by given distances from one end of the rotary bar 253 to which the first side gear 261 is fitted.

The first side gear 261 engages with the second side gear 262, and if any one of the first side gear 261 and the second side gear 262 rotates, the other side gear also rotates. Accordingly, if any one of the first side gear 261 and the second side gear 262 rotates, the third gears, which are connected to the first side gear 261 through the rotary bar 253, also rotate.

The first side gear 261 is rotatable by means of the electric driver, and the second side gear 262 is rotatable by means of the auxiliary handle. To do this, the first side gear 261 has a groove portion 261*a* formed at the inside thereof to insert the end of the electric driver thereinto, and the second side gear 262 has a bar type protrusion 262*a* protruding therefrom in such a manner as to be inserted into the end of the auxiliary handle.

Figure 7:
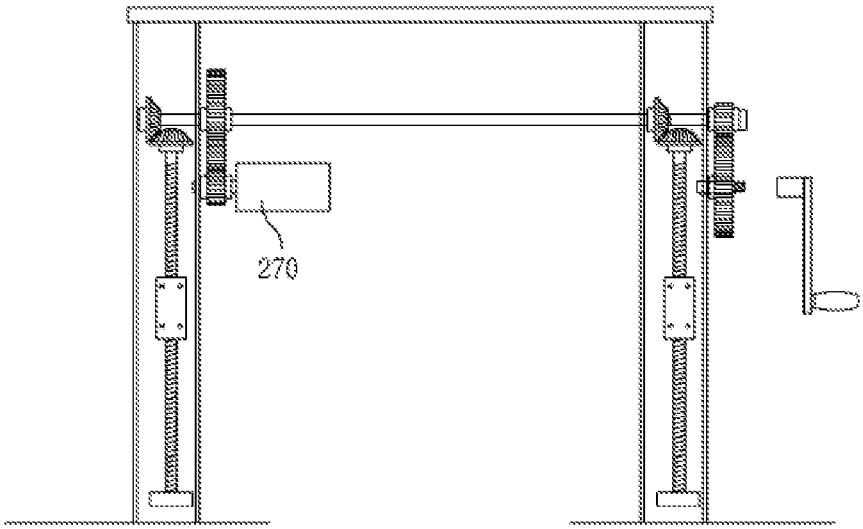
FIG. 7 is a sectional view showing an automatic ladder whose length is adjustable by means of an electric motor according to another embodiment of the present invention.

FIG. 7 is a sectional view showing an automatic ladder whose length is adjustable by means of an electric motor according to another embodiment of the present invention.

As shown in FIG. 7, adjustment in the length of the ladder using the electric motor is carried out by rotating the rotary bar through the electric motor. In detail, the automatic ladder according to the present invention is configured to rotate the rotary bar by means of the electric motor 270, instead of the electric driver, and to do this, a battery is built in at the inside of the ladder to drive the electric motor 270. Of course, the electric motor 270 may be driven by means of the power supplied from the outside.

Figure 8:
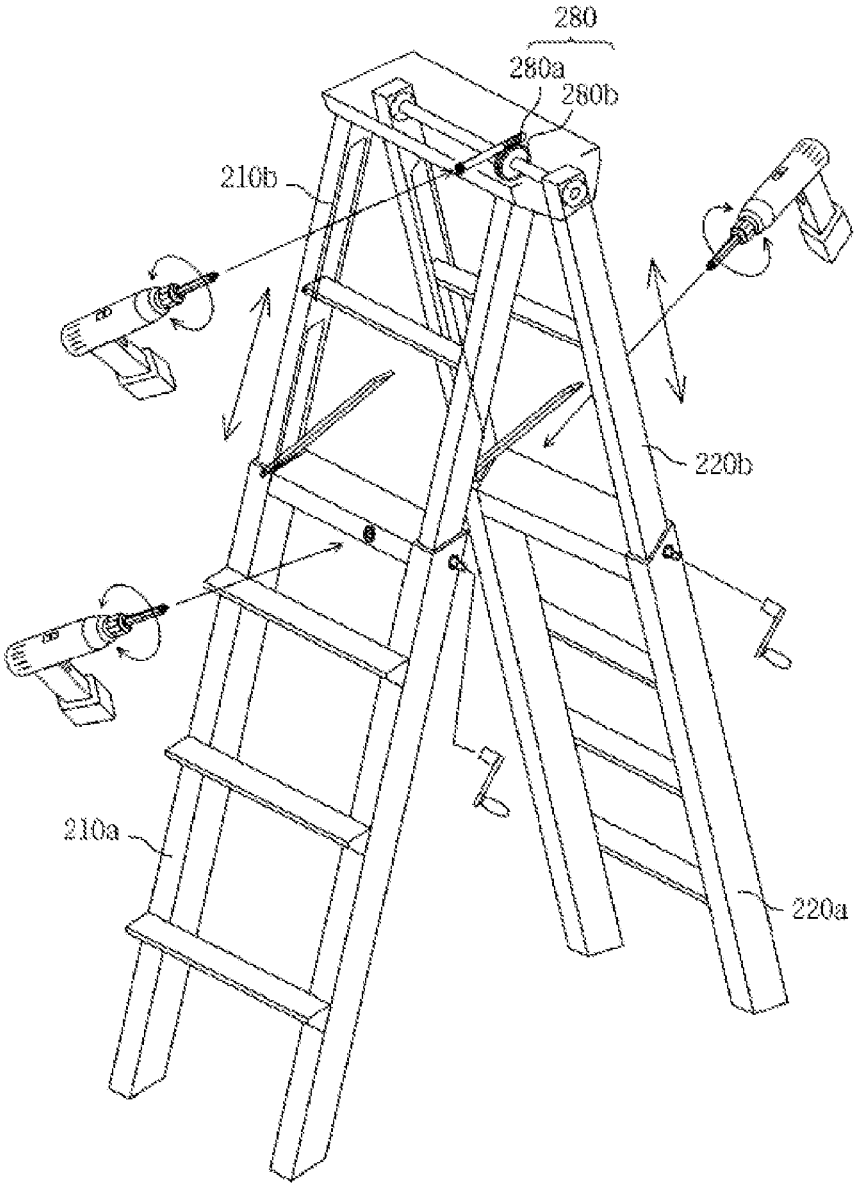
FIG. 8 is a perspective view showing a double sided ladder whose length and angle are adjustable according to yet another embodiment of the present invention.

FIG. 8 is a perspective view showing a double sided ladder whose length and angle are adjustable according to yet another embodiment of the present invention. Hereinafter, the double sided ladder whose length and angle are adjustable according to the present invention will be in detail explained with reference to FIG. 8.

The first support part as shown in FIG. 2 includes the first outer supports and the first inner supports, and the second support part does not include any second outer supports and second inner supports. As shown in FIG. 8, contrarily, the first support part 210 includes the first outer supports 210*a* and the first inner supports 210*b*, and the second support part 220 includes second outer supports 220*a* and second inner supports 220*b*. In the same manner as the first inner supports, accordingly, the second inner supports are drawn from the second outer supports by means of the electric driver or auxiliary handle, and to do this, the second support part has the same configuration as the first support part.

According to the present invention, furthermore, an angle between the first support part and the second support part can be adjusted. The adjustment in angle between the first support part and the second support part is carried out by means of worm gears 280. A bar-shaped first worm gear 280*a* is coupled to the work foothold, and an oval-shaped second worm gear 280*b* is coupled to the second support part. Of course, the work foothold is coupled to the end of the first support part. The first worm gear 280*a* has a groove portion formed thereon to insert the end of the electric driver thereinto, and if the first worm gear 280*a* rotates by means of the electric driver, the second worm gear 280*b* also rotates, so that the angle between the first support part and the second support part can be adjusted. Of course, the first worm gear 280*a* can rotate by means of the auxiliary handle, and in this case, the first worm gear 280*a* has a protrusion protruding from the end thereof, instead of the groove portion formed thereon.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

According to the present invention, advantageously, the automatic ladder can be adjusted in angle as well as length. Further, the automatic ladder according to the present invention is configured to allow the inner supports extendable from the outer supports to be accommodated in the outer supports, and if necessary, the inner supports are extended from the outer supports, so that the ladder of the present invention can be easily moved and kept.

The invention claimed is:

1. An automatic ladder whose length is adjustable, comprising:

a first support part having first outer supports and first inner supports inserted into the first outer supports;

horizontal footholds for connecting the first outer supports and for connecting the first inner supports;

a first gear disposed inside one horizontal foothold and having a groove portion formed at the inside thereof;

a second gear engaging with the first gear and rotating in a direction perpendicular to that of the first gear;

a rotary bar coupled to the second gear;

third gears located on both ends of the rotary bar;

screw bolts having fourth gears engaging with the third gears, located inside the first inner supports, taking shapes of bars, and having screw lines formed on the outer peripheral surfaces thereof; and screw nuts fitted to the screw bolts in such a manner as to allow the outer surfaces thereof to be fixedly coupled to the first inner supports.

2. The automatic ladder according to claim 1, further comprising side gears disposed on the side of the first support part in such a manner as to be connected to the rotary bar.

3. The automatic ladder according to claim 2, wherein the side gears comprise:

a first side gear having a protrusion protruding from the center thereof; and a second side gear engaging with the first side gear and having a groove portion formed at the center thereof.

4. The automatic ladder according to claim 3, wherein the horizontal footholds are hinge-coupled to one side surface of the first inner supports.

* * * * *